United States Patent [19]

Stier et al.

[11] Patent Number: 4,467,689

[45] Date of Patent: Aug. 28, 1984

[54] CHORD RECOGNITION TECHNIQUE

[75] Inventors: Glenn R. Stier, Vernon Hills; Mark J. Fimoff, Hoffman Estates, both of Ill.

[73] Assignee: Norlin Industries, Inc., White Plains, N.Y.

[21] Appl. No.: 391,019

[22] Filed: Jun. 22, 1982

[51] Int. Cl.[3] ..... G10F 1/00

[52] U.S. Cl. ..... 84/1.03; 84/1.24; 84/DIG. 22; 84/1.01

[58] Field of Search ..... 84/1.03, 1.01, 1.24, 84/DIG. 22

[56] References Cited

U.S. PATENT DOCUMENTS

| | | | |
|---|---|---|---|
| 4,332,183 | 6/1982 | Deutsch | 84/1.24 |
| 4,379,420 | 4/1983 | Deutsch | 84/1.03 |
| 4,381,689 | 5/1983 | Oya | 84/1.01 |

*Primary Examiner*—Forester W. Isen

*Attorney, Agent, or Firm*—Ronald J. Kransdorf

[57] ABSTRACT

A method and apparatus for inhibiting the spurious recognition of new chords in an automatic chord recognition system by permitting a new chord group or chord type to be recognized only if the performer has operated the same or a greater number of keys since the last time an attempt was made to recognize a chord or the last time a valid chord was recognized.

8 Claims, 3 Drawing Figures

ELECTRONIC ORGAN CIRCUITRY
OSCILLATOR
HARMONIC SPECTRUM ADJUSTER
MODULATOR
ENVELOPE GENERATOR
KEYBOARD
BOSSA NOVA
BIG BAND
BARO QUE
JAZZ GUITAR
CONTEMPORARY GUITAR & CELLI
GENERAL PURPOSE RAM
PROGRAM ROM
ORCHESTRATION & INSTRUMENT ROM
MICRO-PROCESSOR
LATCH
COUPLING NETWORK

CHORD RECOGNITION TECHNIQUE

BACKGROUND OF THE INVENTION

This invention relates to electronic musical instruments, and more particularly to such instruments in which a keyboard is used by a performer to establish a desired harmony.

Electronic musical instruments, such as keyboard-controlled electronic organs, have experienced wide acceptance among musicians. Since many of these instruments are sold to amateurs, manufacturers place special emphasis on the ease of playing. In particular, efforts have been made to simplify the key manipulations required by a performer in order to play accompaniment chords while still permitting the performer to play chords on an accompaniment keyboard.

Examples of a prior art chord recognition systems are shown in U.S. Pat. No. 4,248,118 issued to George R. Hall and Robert J. Hall on Feb. 3, 1981, entitled "Harmony Recognition Technique Application" and assigned to the assignee of the present application (hereinafter referred to as the "'118 patent"). The systems of this patent are capable of detecting the one or more accompaniment keys of an accompaniment keyboard which have been operated by a performer and of making a determination as to the most likely chord root and chord type which the performer wished to sound. These systems also inhibit the sounding of musically invalid chords.

However, as sophisticated as the chord recognition systems of the '118 patent, or other techniques for performing the same function, may be, there are situations where improper key manipulation by a performer can cause undesired outputs. The very sophistication of the system sometimes leads to these erroneous outputs.

Perhaps the most common error of this type results from the sloppy release of the keys operated to sound a given chord. For example, assume that a C major chord made up of the notes C, E, and G was being sounded. If the performer were to release the notes for example in the order G, C, E and, in particular, if the performer were somewhat slow in releasing the E note, the chord recognition systems of the '118 patent would recognize that an E major chord was being called for and would sound this chord even though the playing of such a chord was not intended by the performer. A similar problem could result from any sloppiness in the release of accompaniment keys by the performer because of the fact that the systems of the '118 patent always attempt to determine the most likely chord being selected by the musician when any one or more keys of the accompaniment keyboard are being operated.

SUMMARY OF THE INVENTION

It is therefore a primary object of this invention to provide a system for reducing the likelihood of spurious chord recognition in an automatic chord recognition system.

A more specific object of this invention is to provide a technique for use in such a system which inhibits the spurious recognition of new chords when the keys being operated for a selected chord are being released.

In accordance with the above objects, this invention provides a method and apparatus for reducing spurious chord recognitions in an electronic keyboard musical instrument of the type having an accompaniment keyboard and a means for identifying a predetermined root note and chord type when a selected one or more keys of the accompaniment keyboard are operated during a given time.

The invention includes means for performing the step of detecting when one or more of the accompaniment keys defining a valid chord have been operated and for storing a first number equal to the number of keys which are operated when the detecting step occurs. Means are also provided for storing a second number equal to the number of keys which were operated during the last time period. Means are further provided for determining if the number of keys operated during a given time period are equal to or greater than the stored first number or the stored second number, an output representative of a new root note and/or new chord type being permitted only in response to an affirmative determination from such determining means.

The foregoing and other objects, features and advantages of the invention will be apparent from the following more particular description of the invention which is provided in conjunction with the accompanying drawings.

DETAILED DESCRIPTION

Figure 1:
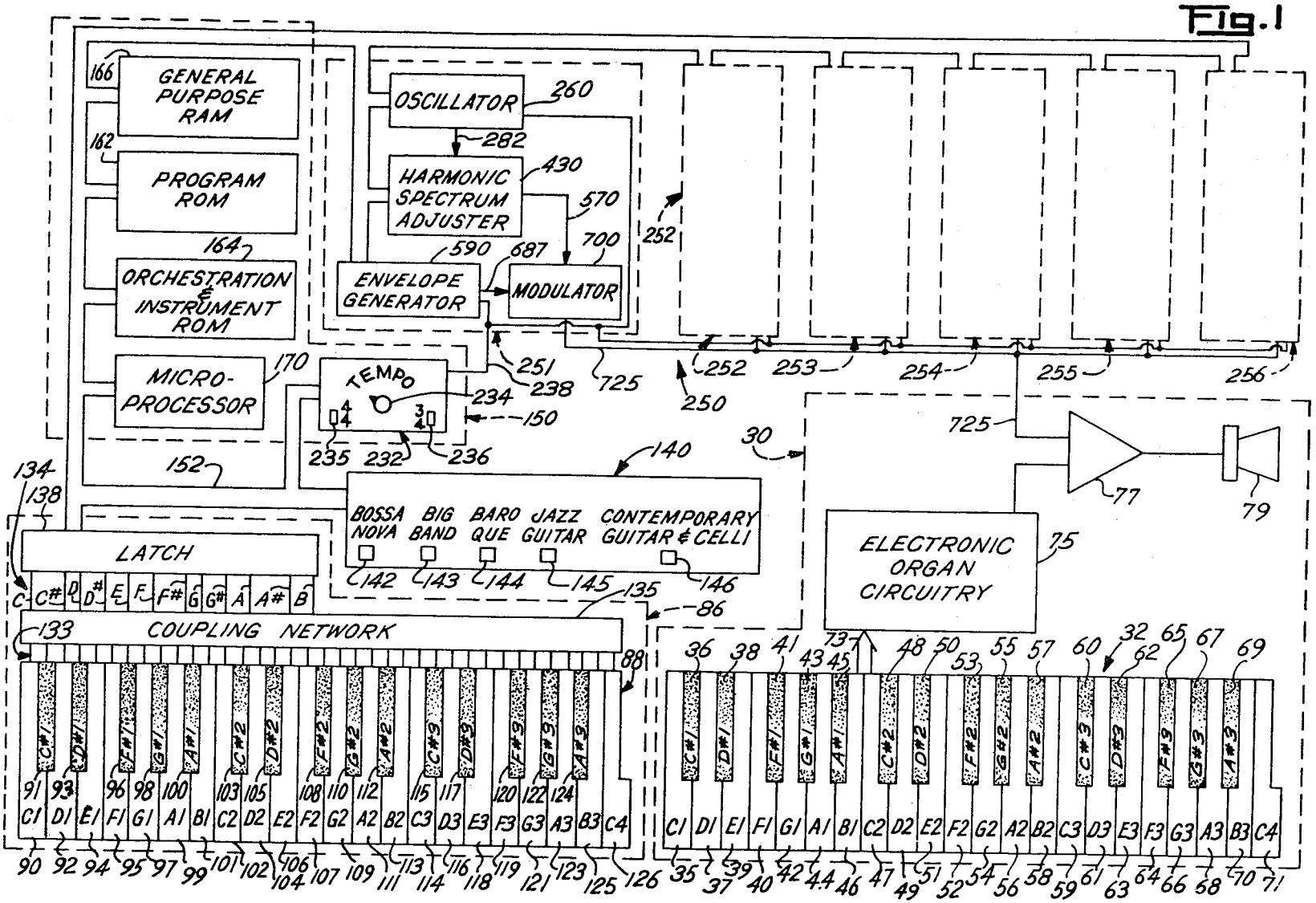
FIG. 1 is a logical block diagram of a preferred form of the musical instrument in which the present invention can be employed.

The preferred embodiments of the present invention can be advantageously used in connection with an electronic musical instrument capable of providing a full orchestral accompaniment to a melody played in any one of the 12 possible harmonic keys. A block diagram of such an instrument is shown in FIG. 1. The instrument is more specifically described in the '118 patent and in copending continuation application of the present inventors and Jack C. Cookerly entitled "Orchestral Accompaniment Techniques", U.S. Pat. application Ser. No. 307,161 filed Sept. 30, 1981 (continuation of application Ser. No. 3,584 filed Jan. 15, 1979), which patent and continuation application are incorporated by reference.

Basically the performer plays a melody with his right hand on a melody keyboard, and indicates a desired harmony by playing with his left hand on a harmony keyboard. The instrument automatically generates a full accompaniment based on the harmony selected by the left hand of the performer on the harmony keyboard. However, before the accompaniment can be generated by the instrument, the chord type and root selected by the performer's manipulation of the harmony keyboard must be ascertained. The chord types recognized by the instrument are major, minor, diminished, augmented and seventh, and the root note can be any of the twelve notes of the musical chromatic scale.

Referring to FIG. 1, a preferred form of electronic musical instrument suitable for use in connection with the present invention basically comprises a melody system 30, a musical style selector 140, a processing system 150 and an output system 250. As shown in FIG. 1, melody system 30 includes a conventional melody keyboard 32 which comprises playing keys 35–71. Each of the keys represents at least one note which is pitched in at least one octave. Keyboard 32 is connected through a cable 73 to conventional electronic organ circuitry 75. The circuitry produces audio tone signals based on the melody keys depressed by the performer in a well-known manner. The tone signals are transmitted through an output amplifer 77 to a conventional loudspeaker transducer 79 which converts the signals to sound.

Musical style selector 140 comprises switches 142–146 by which a performer can select any one of a plurality of musical styles (five for the embodiment shown). In response to the depression of one of switches 142–146, an eight bit word corresponding to the desired style is stored in a conventional eight bit register contained within selector 140. The word is read by processing system 150 and is used in a manner described in the above-identified copending application.

Processing system 150 comprises a communication bus 152 and also includes a program read only memory (ROM) 162 which stores instructions for the overall system. An orchestration and instrument ROM 164 stores digital information necessary for the production of the musical segments which make up the accompaniment. A general purpose random access memory (RAM) 166 is used to hold intermediate variables and working data pointers used by a microprocessor 170 which performs sequential programmed logic functions in order to operate the system.

Microprocessor 170 comprises various standard computer, clock and other components as described in greater detail in the '118 patent and the above identified application.

Referring to FIG. 1, a tempo clock 232 is provided in order to synchronize the system with the performer. The tempo clock may be speeded up or slowed down to suit the tempo at which the performer wishes to play. The tempo is established by rotating knob 234 which adjusts the rate at which tempo clock pulses are generated.

According to a perferred form of the present invention, a harmony selection system 86 cooperates with processing system 150 in order to recognize the harmony indicated by the depression of one or more keys of keyboard 88 by the performer.

Harmony selection system 86 comprises a harmony keyboard 88, including playing keys 90–126. The keys operate switch contacts 133 which correspond to switches 23 described in U.S. Pat. No. 3,745,225 (Hall-July 10, 1973, hereafter the "'225 Patent"). The switch contacts are connected through output conductors 134 (corresponding to conductors 24 of the '225 Patent) by a coupling network 135 of the same type described in that patent. Conductors 134 are connected to a conventional 12 bit latch 138 which can be addressed and read by processing system 150.

Each of the keys of keyboard 88 represents at least one note pitched in at least one octave. One such note and octave is printed on the keys in FIG. 1. For example, key 90 is used to produce at least a C note pitched in octave 1, and key 106 is used to produce at least an E note pitched in octave 2. As explained in the '225 Patent, coupling network 135 is arranged so that the playing of any key on keyboard 88 which corresponds to a C note results in a logical one signal on the C conductor of group 134, irrespective of the octave in which the C note is pitched. For example, the C conductor in group 134 will be raised to a logical one state if any or all of keys 90, 102, 114 or 126 are depressed by a performer. As a result, the input to latch 138 represents each of the notes produced by a performer's manipulation of keyboard 88, but does not indicate in which octave any of the notes are pitched.

By using the following techniques, the harmony desired by the performer can be recognized solely from his manipulation of keyboard 88. In order to recognize any chord type, the microprocessor attempts to match a representation of a playing key pattern with a corresponding chord type and root. In order to achieve this result, various playing key pattern representations are created. A performer may express a desire for a particular chord type based on a particular root by depressing the playing keys according to a number of different patterns. For example, the performer may express a desire for C minor harmony (i.e., chord type minor, root C) by actuating any one of the following key patterns:

1. C, D♯
2. C, D♯, G
3. C, D♯, G, B
4. C, D♯, B
5. D♯, F, A♯
6. C, D♯, F, A♯
7. C, D♯, F, G (In this specification, the symbol ♯ denotes a musical sharp.)

These key patterns can be used by the processor in several ways in order to derive a chord type signal indicating the chord type desired by the performer and a root signal indicating the root note of the harmony desired by the performer. According to a first system described in detail in the '118 patent, the playing key patterns can be converted to digital signals representing addresses of memory locations which store signals defining the chord type and root corresponding to the key pattern. If the memory locations store the chord type and root signals at addresses corresponding to the key pattern representations, the chord type and root signals may be obtained by merely reading their values from the memory. In such an embodiment, the stored representations of the key patterns are created by the circuitry forming the memory addressing logic. This technique results in rapid processing, but requires a considerable amount of memory.

Alternatively, an algorithm could be developed which would represent each of the key patterns desired to be recognized as a particular chord type. In this case, the algorithm would be stored as a general representation of the key patterns.

According to a second system described in the '118 patent, the various key pattern representations can be stored in memory locations having addresses which indicate the chord type of the pattern. More specifically, for each chord type desired to be recognized, a plurality of chord pattern signals representing corresponding key patterns are stored in memory locations having addresses related to that chord type. After the chord pattern signals have been stored, harmony selection system 86 generates a playing key pattern signal identifying the pattern of the playing keys actuated by the performer and also identifying at least one note represented by at least one of the actuated playing keys. The playing key pattern signal then is used in an attempt to locate a corresponding stored chord pattern signal. The chord type signal and root signal are derived from the corresponding chord pattern signal.

The details of how the instrument shown in FIG. 1 operates to derive chord type and root signals in accordance with either of the systems described above are provided in the '118 patent and are incorporated herein by reference. Either of these systems greatly simplifies the playing of harmony notes by an inexperienced performer, permitting such performer to sound a full chord, for example a C major chord, by operating as few as a single key, for example any C key on harmony keyboard 88. However, the very sophistication of these systems can result in the instrument sounding spurious chords when the instrument is played by an inexperienced performer. In particular, while the systems will not permit invalid chords to be sounded, if the performer adds and/or releases keys in the wrong order, or if the keys are released slowly, the systems may determine that the performer has selected a new chord when such is in fact not the case. An example of how this may occur has been described above.

Figure 2:
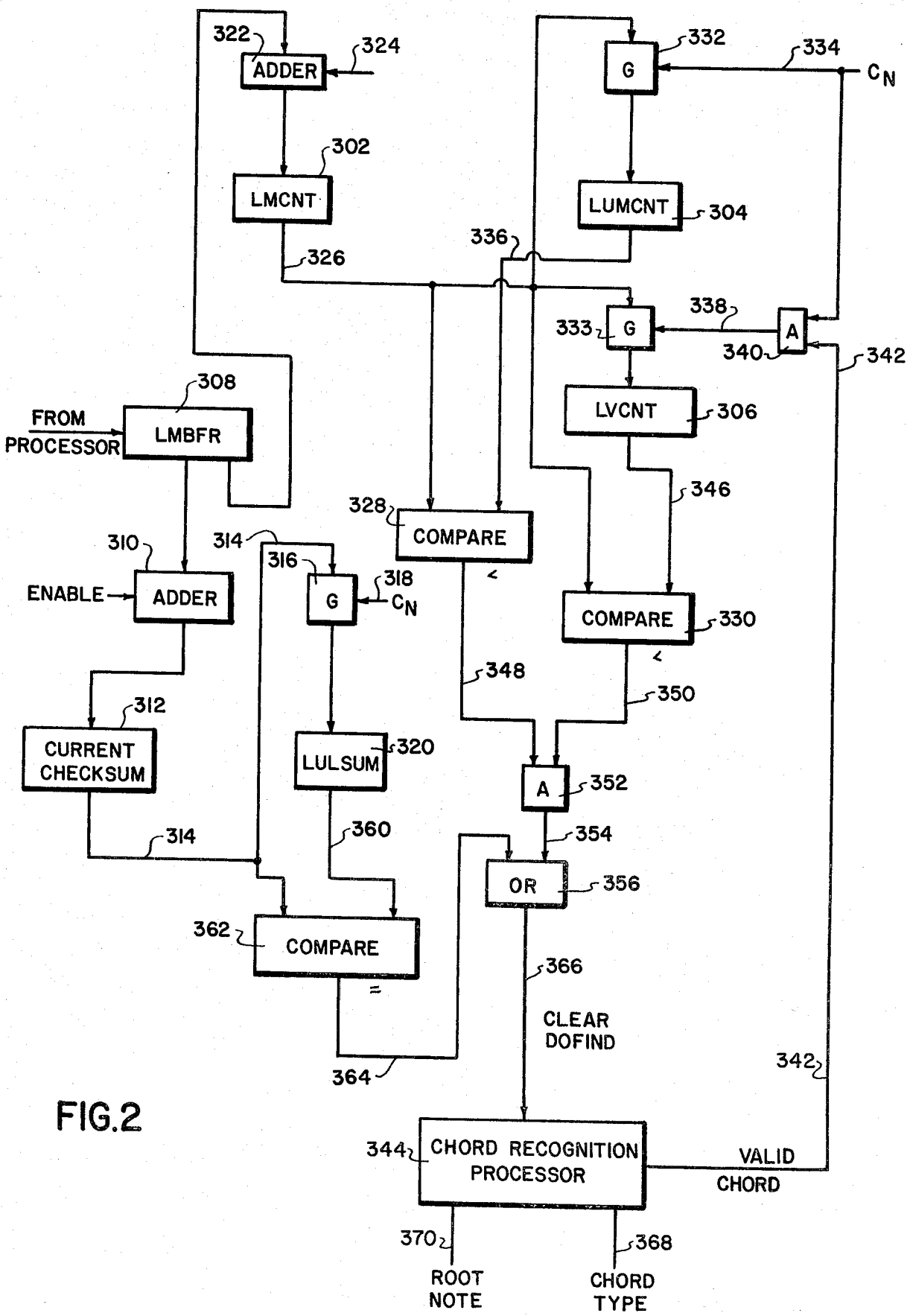
FIG. 2 is a block diagram of circuitry usable for performing the teachings of a preferred embodiment of this invention.

FIG. 2 shows in block diagram form various components which may be used as a preprocessor to inhibit the operation of the chord recognition systems described above and in the '118 patent under certain circumstances. The preprocessor of FIG. 2 operates in general to determine if the performer has operated the same or a greater number of keys since the last time the system checked to determine if a chord was operated or the last time a valid chord was recognized and inhibits the recognition of a new chord if neither of the above conditions is satisfied.

Referring to FIG. 2, the circuit includes an LMCNT register 302 which stores a number equal to the number of keys on harmony keyboard 88 which are operated at any given time. LUMCNT register 304 stores a number equal to the number of keys on keyboard 88 which were operated during the last time period. LVCNT register 306 stores a number equal to the number of keys which were operated the last time a valid chord was recognized. For example, if the performer were to operate the C, E and G keys on keyboard 88, the chord recognition system would recognize a C major chord and register 306 would store the number "3". If a D# note were then struck creating an invalid chord, the C major chord would continue to be sounded and register 306 would continue to store a "3" even though registers 302 and 304 were storing the number "4".

LMBFR 308 is a RAM in which processor 170 stores a number which is representative of each of the twelve notes. For example, the note C might be represented by the number 75, the note C# by the number 76, and so on. The numbers stored in memory 308 are added in adder 310 under the control of a suitable enabled signal from the processor and the sum of these numbers is stored in CURRENT CHECKSUM register 312. The sum stored in register 312 is applied through line 314 and gate 316, which gate is enabled by a clock signal on line 318, to LOLSUM register 320. Register 320 thus stores the checksum which was in register 312 during the previous time interval. The number of address locations in memory 308 which are being used at a given time interval are added in adder 322 under control of a suitable enable signal on line 324 from the processor and the resulting sum is stored in register 302.

Output line 326 from register 302 is connected as one input to compare circuit 328, as one input to compare circuit 330 and as the input to gates 332 and 333. Gate 332 is enabled by a suitable clock signal on line 334 from the processor. The output from gate 332 is applied to load register 304. Output line 336 from register 304 is connected as the other input to compare circuit 328.

The enable input to gate 333 is output line 338 from AND gate 340. The inputs to AND gate 340 are clock line 334 and output line 342 from chord recognition processor 344. Chord recognition processor 344 could, for example, be one of the chord recognition systems of the '118 patent with a signal appearing on line 342 when a valid chord is detected by one of these systems. A signal appears on line 342 when processor 344 recognizes a valid chord. Output line 346 from register 306 is connected as the other input to compare circuit 330. The less-than outputs 348 and 350 from compare circuits 328 and 330 respectively are connected as the inputs to AND gate 352. Output line 354 from AND gate 352 is connected as one input to OR gate 356. Output lines 314 and 360 respectively from registers 312 and 320 are connected as the inputs to compare circuit 362. Equal output line 364 from compare circuit 362 is connected as the other input to OR gate 356. Output line 366 from OR gate 356 is connected as an input to chord recognition processor 344 and is operative to clear or reset a DOFIND bit in the chord recognition processor inhibiting the processor from recognizing a new chord type or a new root note on its output lines 368 and 370 respectively.

Figure 3:
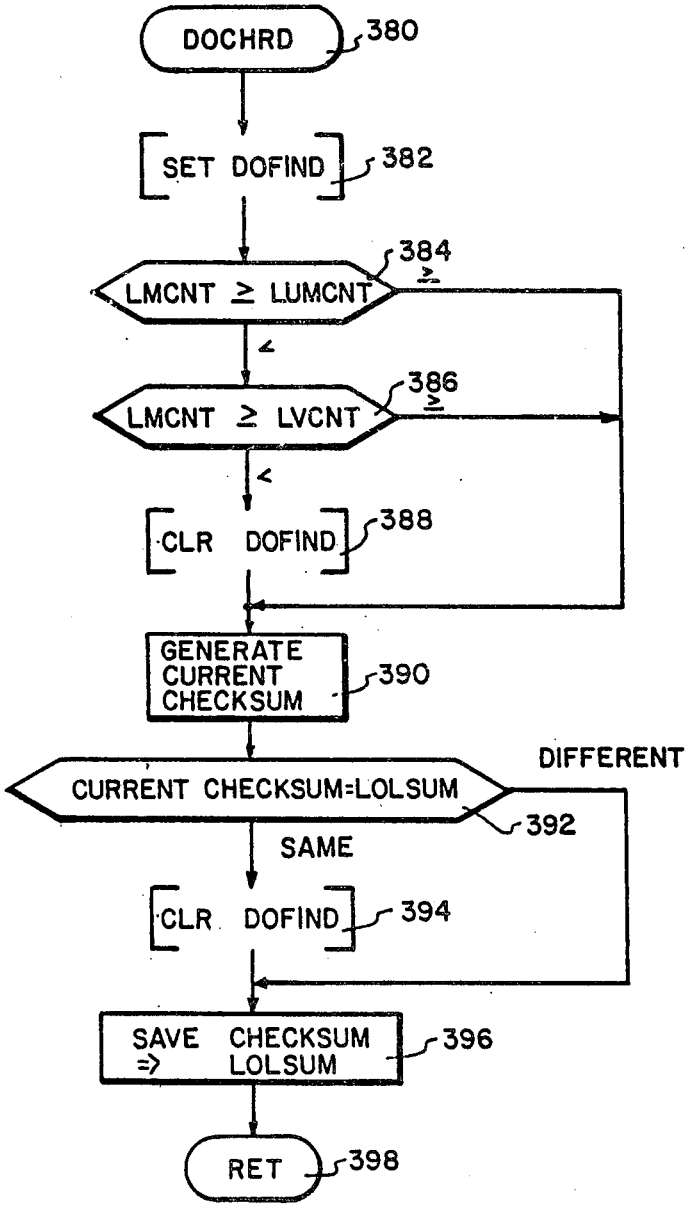
FIG. 3 is a flow chart illustrating the manner in which spurious chord recognitions are prevented in accordance with a preferred embodiment of this invention.

Referring now to FIG. 2 and 3, processor 170 enters a DOCHORD routine through step 380 prior to performing a chord recognition routine such as that shown in FIG. 6 of the '188 patent. The first step in the DOCHORD routine, step 382, is to set the DOFIND bit in processor 170 or 344. As previously indicated, the chord recognition system will recognize a new chord during the performance of a chord recognition routine only if the DOFIND bit is set.

The next step in the process, step 384, is to compare the contents of LMCNT register 302 with the contents of LUMCNT register 304. This comparison step, which may for example be performed in compare circuit 328 or under program control in processor 170, effectively compares the number of keys presently being operated with the number of keys which were operated during the last sampling time interval. If the present count in register 302 is less than the previous count in register 304 the routine proceeds to step 386 during which the contents of LMCNT register 302 are compared with the count in LVCNT (last-valid-count) register 306. This step may be performed in comparator 330 or under program control in processor 170. If the contents of register 302 are less than the contents of register 306, the process proceeds to step 388 where the DOFIND bit is cleared or reset. As previously indicated, the resetting of the DOFIND bit in processor 344 (or 170) inhibits the recognition of a new valid chord by the processor. In FIG. 2, step 388 is illustrated by applying the less-than outputs from comparators 328 and 330 as inputs to AND gate 352. The output from AND gate 352 is applied through OR gate 356 to clear-DOFIND line 366. Thus, steps 384–388 result in the DOFIND bit being reset if the current count in register 302 is less than both the count during the previous clock cycle stored in register 304 and the count in last valid count register 306. This effectively inhibits the spurious recognition of a new chord when the performer is merely trying to release a chord he has previously played but is somewhat sloppy in doing so.

If a greater than or equal output is obtained either from step 384 or step 386, step 388, the clear-DOFIND step, is bypassed and the program proceeds directly to step 390 where the current CHECKSUM value is generated. When step 388 is completed, the system will also proceed to step 390. During step 390, the contents of LMBFR memory 308 are applied to adder 310 where the numerical values assigned to each of the operated keys are added and the sum is stored in current CHECKSUM register 312.

During the next step in the operation, step 392, the current CHECKSUM value in register 312 is compared with the checksum value during the last time interval stored in LOLSUM register 320. This comparison may be performed in compare circuit 362 or may be performed under program control in suitable general purpose circuitry of microprocessor 170. If the contents of registers 312 and 320 are the same, the program proceeds to step 394 during which the DOFIND bit is cleared. This is illustrated in FIG. 2 by applying the equal output on line 364 from compare circuit 362 through OR gate 356 to clear DOFIND line 366. This step may also be performed in processor 170 under program control. The effect of steps 392 and 394 is to prevent the recognition of a new chord when there has in fact been no change on the accompaniment keyboard defining the chord to be recognized.

If, during step 392, it is found that the contents of registers 312 and 320 are different, step 394 is bypassed, permitting a new chord to be recognized, and the system proceeds directly to step 396, during which the value in CURRENT CHECKSUM register 312 is transferred to LOLSUM register 320. This is illustrated in FIG. 2 by enabling gate 316 by a signal from the processor on line 318 to pass the contents of register 312 to register 320 at the end of the clock cycle. From step 396, the processor executes a return step 398 which causes it to reenter the main routine.

A complete program listing capable of implementing the process described in FIG. 3 on an Intel 8051 microprocessor follows.

While the invention has been described above with reference to preferred embodiments thereof, those skilled in the art will recognize that the foregoing and other changes in form and detail may be made therein without departing from the spirit and scope of the invention.

What is claimed is:

1. Apparatus for reducing spurious chord recognitions in an electronic keyboard musical instrument during a given one of a plurality of time periods, said electronic keyboard musical instrument being of the type having an accompaniment keyboard, and a means for identifying a predetermined root note and chord type when a selected one or more keys of said accompaniment keyboard are operated, comprising in combination:

means for detecting when one or more of said keys defining a valid chord have been operated;

means for storing a first number equal to the number of said keys which are operated when a valid chord is detected by said detecting means;

means for storing a second number equal to the number of said keys which were operated during the time period preceeding said given time period;

means for determining if the number of said keys operated during said given time period are equal to or greater than the stored first number or the stored second number; and means operative in response to said determining means for controlling the sounding of a new root note and/or chord type by said instrument.

2. Apparatus as claimed in claim 1 wherein said means for controlling is operative for permitting a new root note and/or chord type to be sounded by said instrument only in response to an affirmative determination by said means for determining.

3. Apparatus as claimed in claim 1 wherein a numeric value is assigned to each accompaniment note; and including:

first means for storing the sum of the numeric values assigned to the notes corresponding to the keys which are operated during said given time period;

second means for storing the sum which was stored in said first means during said preceeding time period;

means for comparing the sums stored in said first and second means for storing; and means responsive to an equal output from said means for comparing for inhibiting the sounding of a new root note and/or chord type by said instrument.

4. Apparatus as claimed in claim 3 including:

memory means for storing the numeric values assigned to the notes corresponding to the keys operated during said given time period;

means for summing the numeric values stored in said memory means, the output from said summing means being stored in said first means for storing; and means operative after the operations of said means for inhibiting for transferring the contents of said first means for storing to said second means for storing.

5. A method of reducing spurious chord recognition in an electronic keyboard musical instrument during a given one of a plurality of time periods, said electronic keyboard musical instrument being of the type having an accompaniment keyboard, and a means for identifying a predetermined root note and chord type when a selected one or more keys of said accompaniment keyboard are operated, the method comprising the steps of:

detecting when one or more of said keys defining a valid chord have been operated;

storing a first number equal to the number of said keys which are operated when said detecting step occurs;

storing a second number equal to the number of said keys which were operated during the time period preceeding said given time period; and permitting an output representative of a new root note and/or chord type to be sounded by said instrument only if the number of said keys being operated during said given time period is equal to or greater than said first number or said second number.

6. A method as claimed in claim 5 wherein said detecting step includes the steps of:

detecting that a valid chord has been recognized;

determining whether the root note to be sounded has changed;

determining whether the chord type to be sounded has changed;

generating a new valid chord output in response to the combinations of an affirmative result from said detecting step and an affirmative result from at least one of said determining steps.

7. A method as claimed in claim 5 wherein a numeric value is assigned to each accompaniment note; and including the steps of:

storing the numeric values assigned to the notes corresponding to the keys which are operated during said given time period in a first storing means;

storing in a second storing means the sum which was stored in storing means during the preceeding time period;

comparing the sums stored in said first and second storing means; and inhibiting the sounding of a new root note and/or chord type by said instrument in response to a equal determination during said comparing step.

8. A method as claimed in claim 7 including the steps of:

storing in a memory means the numeric values assigned to the notes corresponding to the keys operated during a given time period;

summing the numeric values stored in said memory, the results of said summing step being stored in said first storing means; and transferring the contents of said first storing means to said second storing means after the performance of said inhibiting step.

* * * * *